US006579115B2

(12) United States Patent
Mitsugi

(10) Patent No.: US 6,579,115 B2
(45) Date of Patent: Jun. 17, 2003

(54) ELECTRICAL CONNECTOR

(75) Inventor: Daisuke Mitsugi, Kanagawa (JP)

(73) Assignee: Tyco Electronics, AMP, K.K. (JP)

( * ) Notice: Subject to any disclaimer, the term of this patent is extended or adjusted under 35 U.S.C. 154(b) by 0 days.

(21) Appl. No.: 10/010,888

(22) Filed: Dec. 7, 2001

(65) Prior Publication Data

US 2002/0072269 A1 Jun. 13, 2002

(30) Foreign Application Priority Data

Dec. 8, 2000 (JP) ..... 2000-374560

(51) Int. Cl.[7] ..... H01R 4/24
(52) U.S. Cl. ..... 439/417; 439/418; 439/680
(58) Field of Search ..... 439/417, 418, 439/393, 395, 396, 402–407, 460

(56) References Cited

U.S. PATENT DOCUMENTS

| | | | | |
|---|---|---|---|---|
| 4,371,225 A | | 2/1983 | Narozny | 339/97 |
| 4,669,801 A | * | 6/1987 | Worth | 439/404 |
| 4,693,533 A | * | 9/1987 | Szczesny et al. | 439/350 |
| 5,080,606 A | * | 1/1992 | Burkard | 439/403 |

FOREIGN PATENT DOCUMENTS

| | | | |
|---|---|---|---|
| JP | 52-008490 | 1/1977 | 9/8 |
| JP | 52-048089 | 4/1977 | 9/8 |
| JP | 61-133584 | 6/1986 | 4/24 |

* cited by examiner

*Primary Examiner*—Alexander Gilman
(74) *Attorney, Agent, or Firm*—Barley, Snyder, Senft & Cohen, LLC

(57) ABSTRACT

A connector has a housing, contacts, and a cover housing which is mounted in the housing. Electrical wires are passed through the cover housing, and the tip end portions of the electrical wires are held by clips. When the cover housing holding the electrical wires is pushed into the recess of the housing, the protruding tongue parts of the contacts pierce the outer coverings of the electrical wires, and bite into the conductors of the electrical wires. Since the supporting arms of the clips are positioned so that these supporting arms correspond to the protruding tongue parts, the insulating outer coverings of the electrical wires that are electrically connected by the protruding tongue parts are elastically pressed toward the protruding tongue parts from the outside by the supporting arms of the clips.

7 Claims, 18 Drawing Sheets

ELECTRICAL CONNECTOR

FIELD OF THE INVENTION

The present invention relates to an electrical connector which is connected to electrical wires that have a large number of core wires (conductors) and which is used in fields such as semiconductor manufacturing equipment, industrial machinery and automobiles. In particular the invention relates to an insulation displacement type electrical connector of the type in which electrical connections between the electrical wires and contacts are established as a result of the electrical wires being pierced by portions of the contacts (i.e., the connection parts that form connections with the electrical wires).

BACKGROUND OF THE INVENTION

A typical connector known in the prior art is disclosed in Japanese Unexamined Patent Publication No. 61(1986)-133584. This connector is equipped with a base housing which has a recess that opens to the outside, contacts which are disposed inside this recess, and a cover housing which is mounted in the recess. A plurality of grooves are formed in the cover housing, and electrical wires are held in these grooves. When the cover housing holding the electrical wires is mounted in the recess of the base housing, the electrical wires are pressed against the contact parts (piercing parts) of the contacts. Since the tip ends of the contact parts are sharply pointed, these tip ends pierce the insulating outer coverings of the electrical wires and contact the conductors of the electrical wires; as a result, electrical connections are established between the electrical wires and the contacts. Fastening parts are formed on the contacts in separate positions from the piercing parts, i.e., in positions that are separated from the piercing parts in the axial direction of the contacts and in the direction that intersects the contacts. These fastening parts are arranged so that they engage with the cover housing when the cover housing is attached to the base housing. The cover housing has parts that support the electrical wires (with which electrical connections are made) from the sides.

Japanese Patent Publication No. 56(1981)-30955 teaches of a connector which has a contact that passes through a flexible parallel cable and is connected to the conductor of the parallel cable. This contact has a core wire contact part which pierces the insulating covering of the cable and contacts the conductor (core wire) of the cable, and a pair of crimping parts (crimping barrels) which pierce portions of the insulating outer covering, and are fastened by crimping onto the cable on opposite sides of the cable.

Japanese Patent Publication No. 60(1985)-59709 discloses a terminal which is connected to the conductor of a flat cable. This terminal has triangular teeth. The teeth pierce the insulator of the flat cable, and pass through the conductor of the flat cable, so that an electrical connection is established. Moreover, the teeth are bent on the opposite side of the cable, and are fastened to the cable. Furthermore, a pair of teeth with similar shapes (crimping barrels) that do not contact the conductor pierce the insulator, and are then bent over the cable and fastened to the cable.

Japanese Patent Publication No. 56(1981)-30954 discloses an electrical wire contact element (terminal) which has a groove between a pair of sharp legs, i.e., a so-called insulation displacement connection (IDC) type terminal. When an electrical wire is pressed into the groove of this terminal, the insulating outer covering of the electrical wire is ruptured by the inside edges of the groove, so that the core wire of the electrical wire contacts the inside edges of the groove, thus establishing an electrical connection.

In the connector disclosed in the above-mentioned Japanese Unexamined Patent Publication No. 61(1986)-133584, the parts that support the electrical wires from the side are rigid synthetic resin parts that are caused to protrude as integral parts of the cover housing. Accordingly, when the insulating outer covering of the electrical wire loses its elasticity as time passes, there is a concern that the effective pressing support of the electrical wires against the piercing parts may become difficult. Specifically, there is a concern that the electrical wires may move relative to the piercing parts, so that the reliability of the electrical connections drops. Furthermore, since the fastening parts that are anchored in the cover housing are formed in a separate location that are different from the piercing parts, there is a concern that effective fastening of the electrical wires between the cover housing and the piercing parts may become impossible as a result of elastic deformation between the fastening parts and the piercing parts.

In the connectors disclosed in Japanese Patent Publication No. 56(1981)-30955 and Japanese Patent Publication No. 60(1985)-59709, a special tool is required in order to fasten the crimping barrels to the cable.

In the terminal disclosed in Japanese Patent Publication No. 56(1981)-30954, the terminal is effective in cases where the number of core wires of the electrical wire that is connected is small. However, in the case of connection to a large number of core wires, e.g., 60 core wires, the core wires tend to move inside the grooves, i.e., slots, so that the reliability of the electrical connections drops.

SUMMARY OF THE INVENTION

The present invention was devised in light of the above-mentioned points. It is an object of the present invention to provide a highly reliable electrical connector which allows secure fastening of electrical wires that have numerous core wires and that are connected by piercing, and which maintains the electrical connections of these electrical wires.

Another object of the present invention is to provide an electrical connector which does not require any special tool for the connection of the connector with electrical wires.

The electrical connector of the present invention is an electrical connector which has an insulating housing which has a recess that opens to the outside. Contacts are disposed inside the recess. The contacts have connection parts. An insulating cover member is mounted in the recess and connects electrical wires to the connection parts by pressing the electrical wires against the connection parts. The connection parts having a protruding shape, and are constructed so that the connection parts pierce the insulating outer covering of the electrical wires and are thereby connected to the conductors of the electrical wires. Elastic supporting members, that support the outer covering portions of the electrical wires connected to the connection parts so that the outer covering portions are pressed toward the connection parts, are disposed adjacent to the connection parts at the sides of the connection parts.

The electrical connector of the present invention is also directed to an electrical connector which has an insulating housing which has a recess that opens to the outside. Contacts are disposed inside the recess and have connection parts provided thereon. An insulating cover member is mounted in the recess and facilitates the connection of the electrical wires to the connection parts by pressing the electrical wires against the connection parts. The connection parts have a protruding shape. The connection parts are constructed so that the connection parts pierce the insulating outer covering of the electrical wires and are connected to the conductors of the electrical wires. The connection parts have engaging parts that engage with the cover member mounted in the recess.

The electrical connector of the present invention is also directed to an electrical connector which has an insulating housing with a recess that opens to the outside. Contacts are disposed inside the recess and have connection parts provided thereon. An insulating cover member is mounted in the recess and facilitates the connection of the electrical wires to the connection parts by pressing the electrical wires against the connection parts. The connection parts have a protruding shape, and are constructed so that the connection parts pierce the insulating outer covering of the electrical wires and are connected to the conductors of the electrical wires. Elastic supporting members that support the outer covering portions of the electrical wires connected to the connection parts so that the outer covering portions are pressed toward the connection parts are disposed adjacent to the connection parts at the sides of the connection parts, and the connection parts have engaging parts that engage with the cover member mounted in the recess.

The elastic supporting members may be formed as metal members or insulating members which are separate from the contacts and which are attached to the cover member. The elastic supporting members may also be formed as integral parts of the contacts.

Since the elastic supporting members elastically press the outer covering portions of the connected electrical wires against the connection parts, an electrical connection is always maintained with the connection parts of the contacts even in cases where the electrical wires have a large number of conductors. Even if the insulating outer coverings of the electrical wires harden or undergo deformation, the elasticity of the elastic supporting members constantly compensates for the deformation in shape, so that the effect lasts over time. Accordingly, a connector with highly reliable electrical connections can be obtained.

Since the electrical wires can be directly held between the connection parts and the cover member, the electrical wires can always be securely held between the cover member and the connection parts, so that electrical connections are maintained. Accordingly, a connector with highly reliable electrical connections can be obtained. Furthermore, since there is no need to maintain connections with the electrical wires by press-bonding the contacts, no special tool is required for the connections performed at the work site.

Since the two effects described above are obtained, i.e., since the elastic supporting members elastically press the outer covering portions of the connected electrical wires against the connection parts, and since the electrical wires are directly held between the connection parts and the cover member, a connector with highly reliable electrical connections can be obtained.

In cases where the elastic supporting members are formed as metal members or insulating members which are separate from the contacts and which are attached to the cover member, the electrical wires can also be elastically supported from both sides. Accordingly, in such a case, the electrical wires can be supported even more securely.

In cases where the elastic supporting members are formed as integral parts of the contacts, the number of parts required can be reduced.

BRIEF DESCRIPTION OF THE DRAWINGS

FIG. 18 shows the contact shown in FIG. 17;

FIG. 20 shows the clip shown in FIG. 19;

FIG. 25 shows perspective views of [one of] the contacts used in a connector constituting a second embodiment of the present invention;

FIG. 25A is a perspective view (similar to FIG. 7) of the contact as viewed from the front, while

FIG. 26 A is a right-side view of the contact,

FIG. 27 shows perspective views of the cover housing used in the second embodiment of the present invention;

FIG. 27A is a perspective view of the cover housing as seen from the front, while

DESCRIPTION OF THE EMBODIMENT SHOWN

Figure 1:
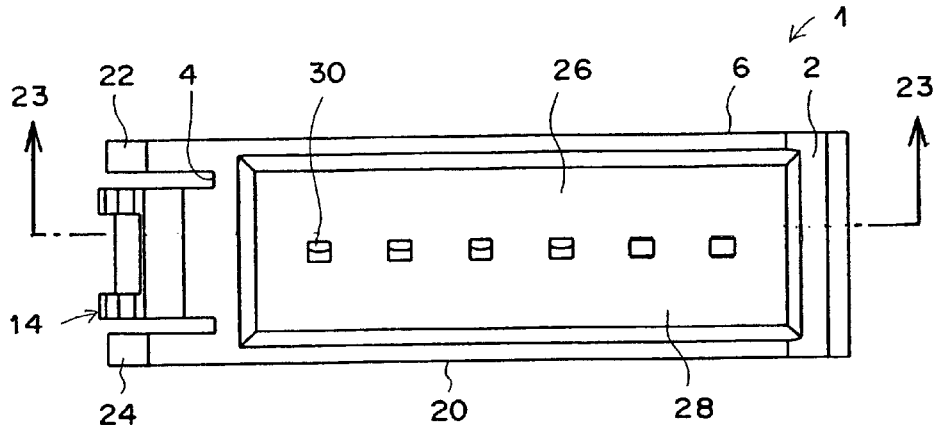
FIG. 1 is a front view of a connector constituting a first embodiment of the present invention.
Figure 2:
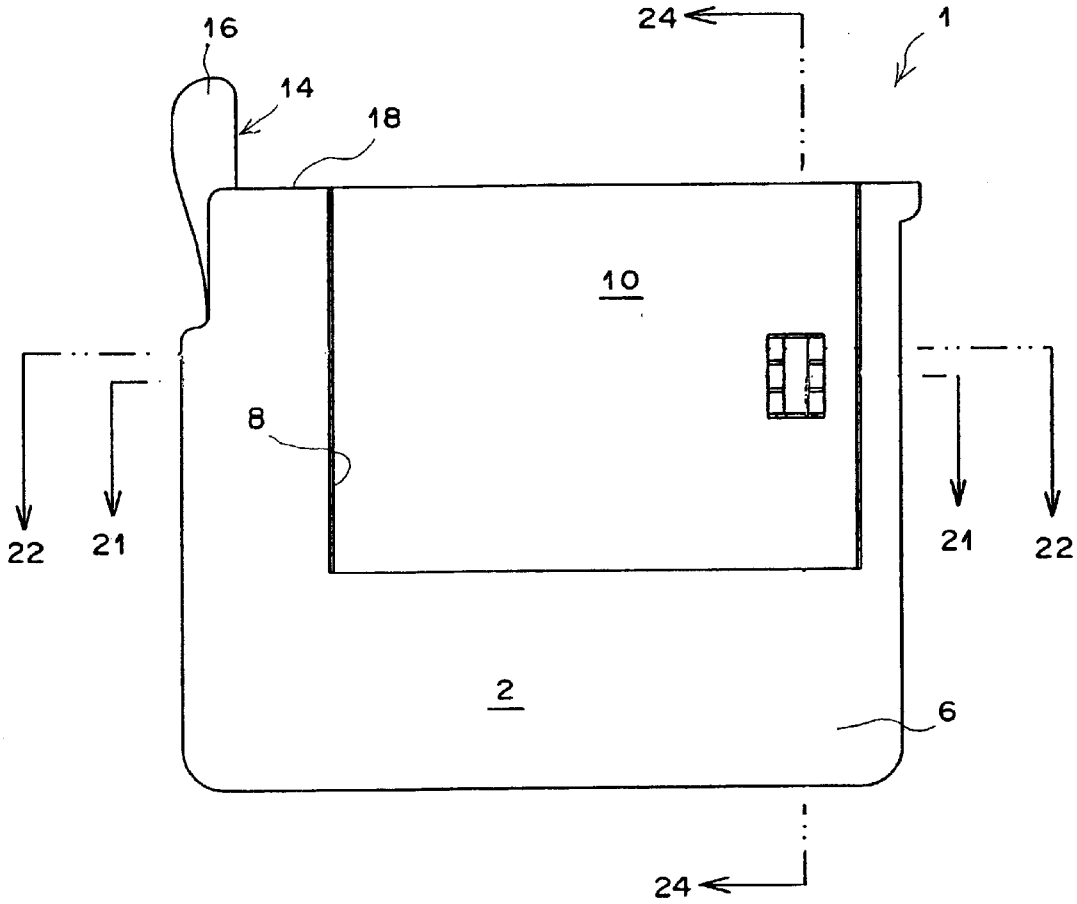
FIG. 2 is a plan view of the connector shown in FIG. 1.
Figure 3:
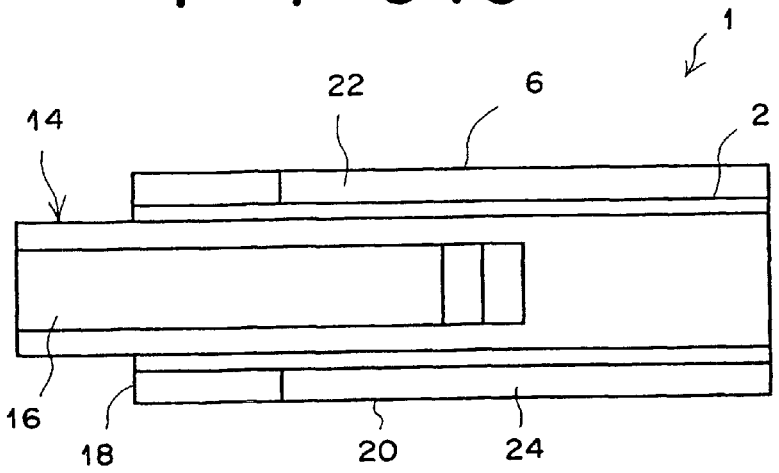
FIG. 3 is a left-side view of the connector shown in FIG. 1.
Figure 4:
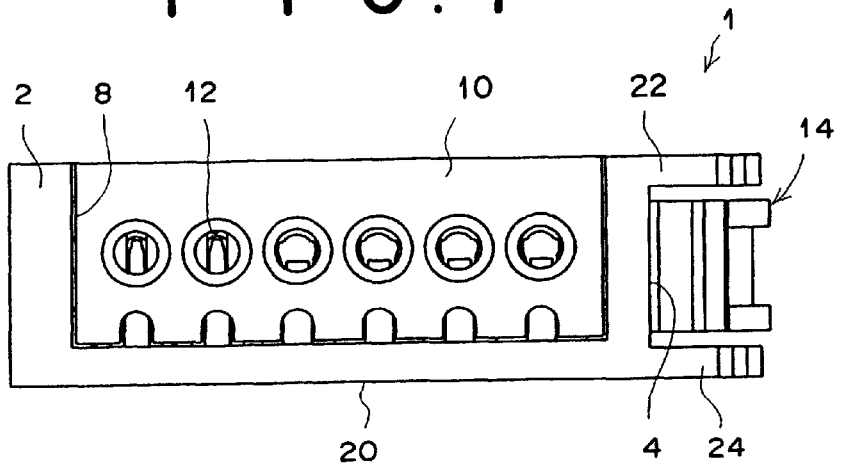
FIG. 4 is a rear view of the connector shown in FIG. 1.

The embodiment shown of the connector of the present invention will be described in detail below with reference to the attached figures. FIG. 1 is a front view of a connector 1 constituting a first embodiment of the present invention. FIG. 2 is a plan view of the connector shown in FIG. 1. FIG. 3 is a left-side view of the connector shown in FIG. 1. FIG. 4 is a rear view of the connector shown in FIG. 1. The following description will make reference to FIGS. 1 through 4.

The housing 2 used in the connector 1 has a substantially rectangular shape with a plan-view shape that is close to square. A rectangular recess 8 is formed in the upper wall 6 of the housing 2 so that this recess 8 extends from the central portion near the front part of the housing 2 (at the bottom in FIG. 2) to the rear part of the housing 2 (FIG. 2). This recess 8 opens at the top and to the rear. A cover housing 10 whose external shape is complementary to that of the recess 8 is mounted inside the recess 8. Round apertures 12 used to lead out electrical wires are formed in the rear part of the cover housing 10 as shown in FIG. 4. The details of the cover housing 10 will be described later. A latching arm 14 which has a fixed end at the front part of the housing 2 is formed on one side wall 4 of the housing 2 as an integral part of the housing 2. The rear end portion 16 of the latching arm 14 protrudes rearward from the rear end 18 of the housing 2. Above and below the latching arm 14, ribs 22 and 24 protrude from the upper wall 6 and lower wall 20 of the housing 2 as integral parts of the housing 2 in the same planes as the upper wall 6 and lower wall 20. A rectangular engaging recess 26 (FIG. 1) is formed in the front part of the housing 2. The connector 1 is arranged so that a mating connector (not shown in the figures) is engaged with this engaging recess 26. Square holes 30 through which contacts are passed are formed in a row in the bottom wall 28 of the engaging recess 26.

Figure 5:
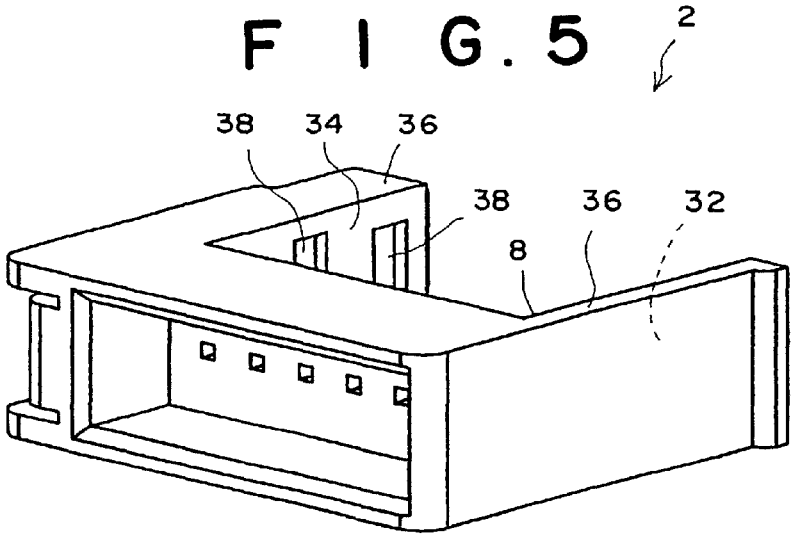
FIG. 5 is a perspective view of the housing used in the connector shown in FIG. 1, as seen at an inclination from the front.
Figure 6:
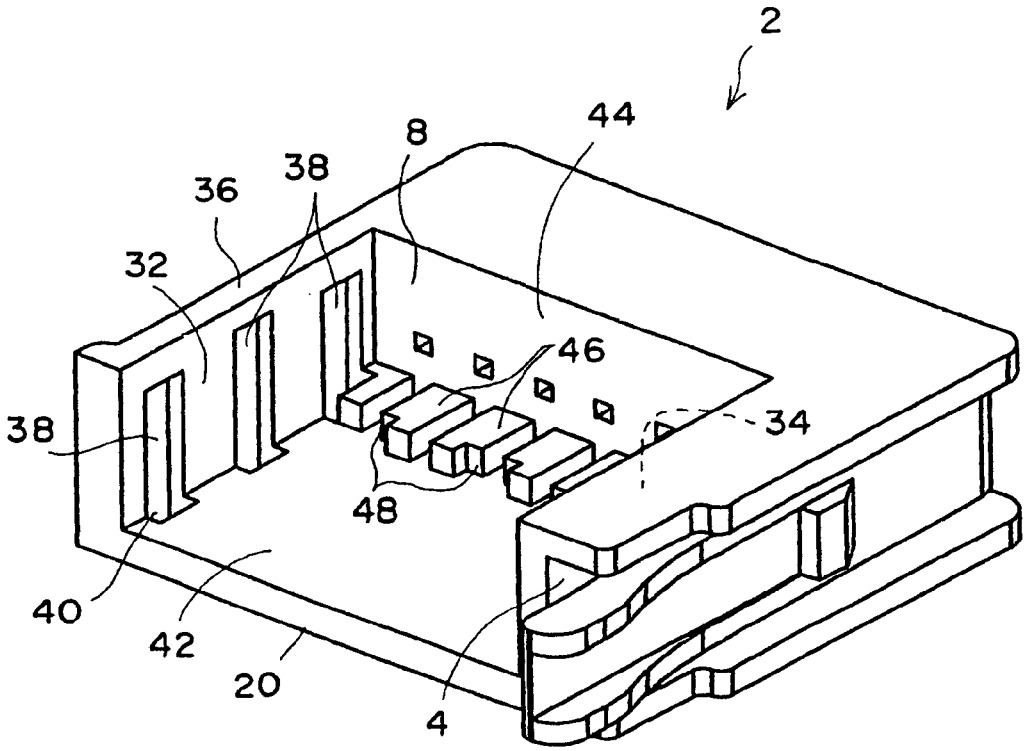
FIG. 6 is a perspective view of the housing shown in FIG. 5, as seen at an inclination from the rear.
Figure 7:
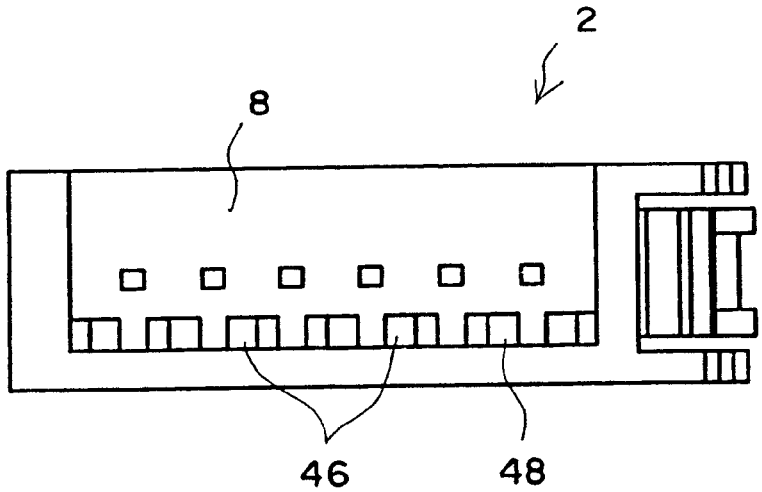
FIG. 7 is a front view of the housing shown in FIG. 5.
Figure 8:
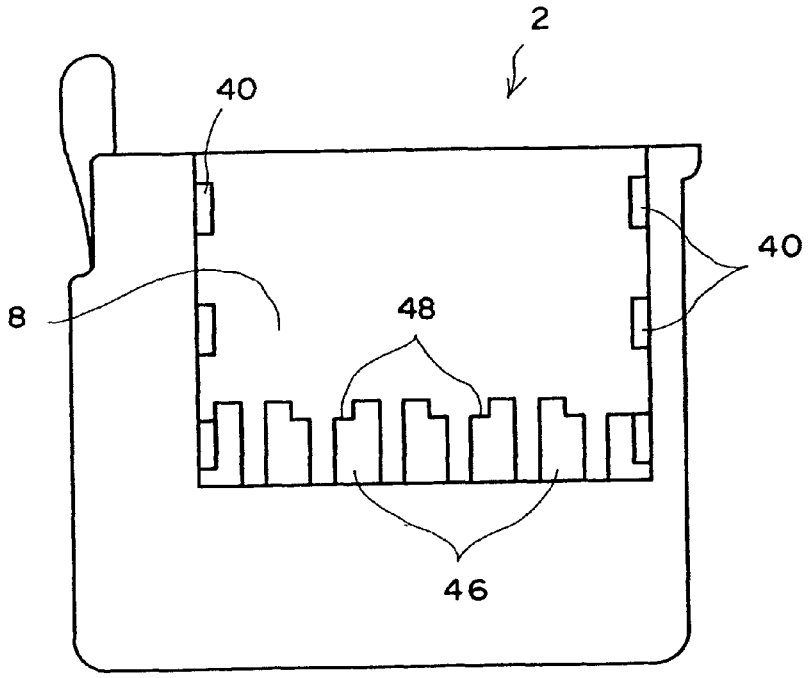
FIG. 8 is a plan view of the housing shown in FIG. 5.
Figure 9:
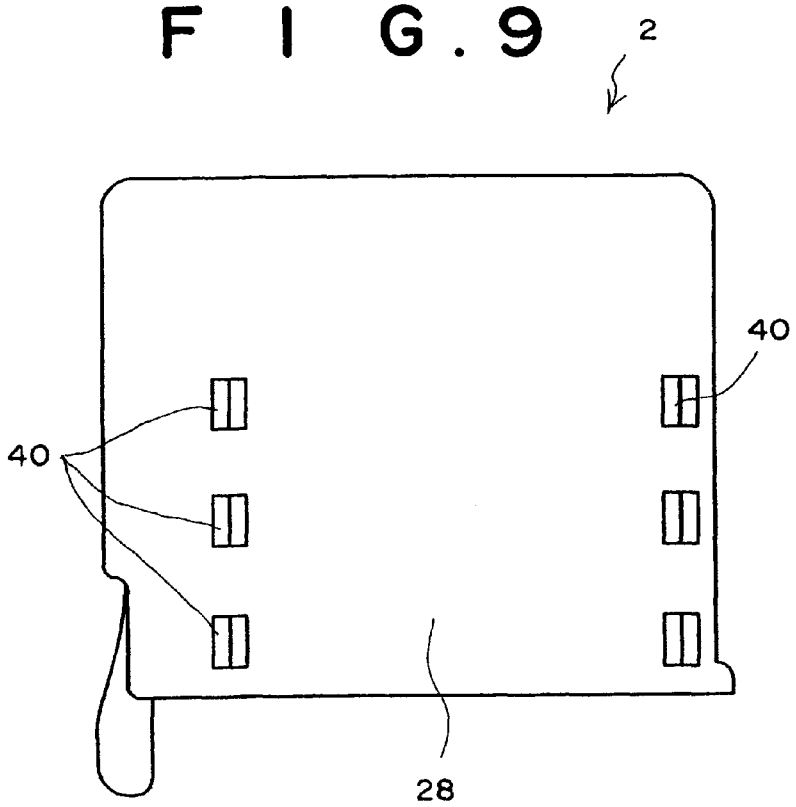
FIG. 9 is a bottom view of the housing shown in FIG. 5.

Next, the details of the housing 2 will be described with reference to FIGS. 5 through 9. FIG. 5 is a perspective view of the housing 2 as seen at an inclination from the front. FIG. 6 is a perspective view of the housing 2 as seen at an inclination from the rear. FIG. 7 is a rear view of the housing 2. FIG. 8 is a plan view of the housing 2. FIG. 9 is a bottom view of the housing 2. In these figures, it is clearly shown that the recess 8 opens at the top and bottom of the housing 2. As is shown most clearly in FIGS. 5 and 6, three recessed grooves 38 which extend downward in parallel from the vicinity of the upper edges 36 of the inside surfaces 32 and 34 of the recess 8 are formed in each of these inside surfaces 32 and 34. These recessed grooves 38 pass through the lower wall 20 and form rectangular openings 40 in the lower wall 20. The role of these recessed grooves 38 will be described later. Furthermore, a plurality of substantially rectangular blocks 46 are caused to protrude as integral parts of the housing 2 from the corner parts between the bottom surface 42 and front surface 44 of the recess 8 along this front surface 44. A cut-out 48 is formed in one side of the rear end of each of these blocks 46. Contacts 100 (FIG. 17) which will be described later are disposed in the areas formed by these mutually facing cut-outs 48.

Figure 10:
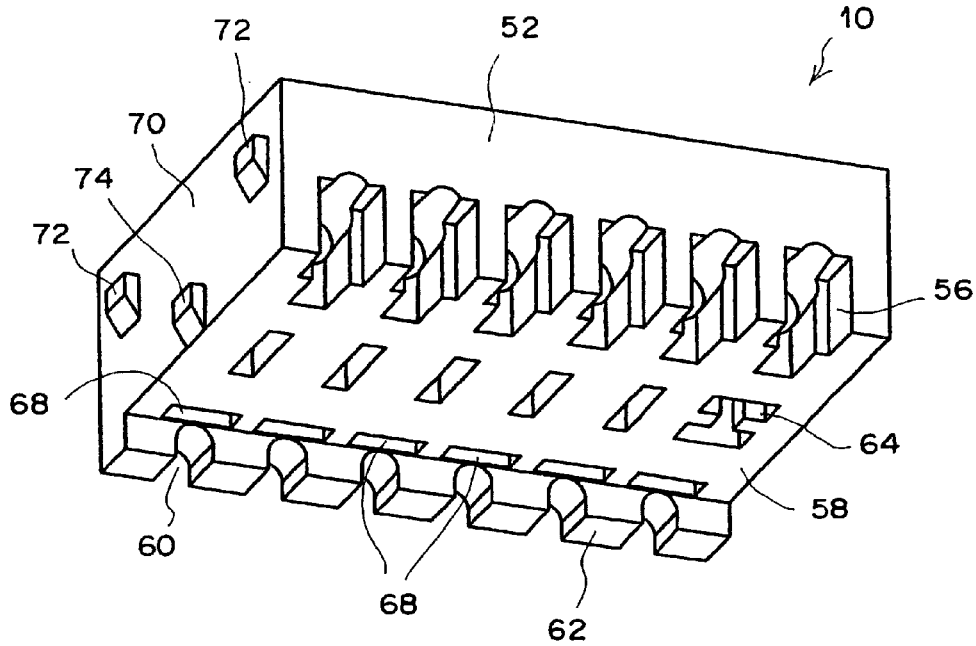
FIG. 10 is a perspective view of the cover housing used in the connector shown in FIG. 1, as seen from below and in front.
Figure 11:
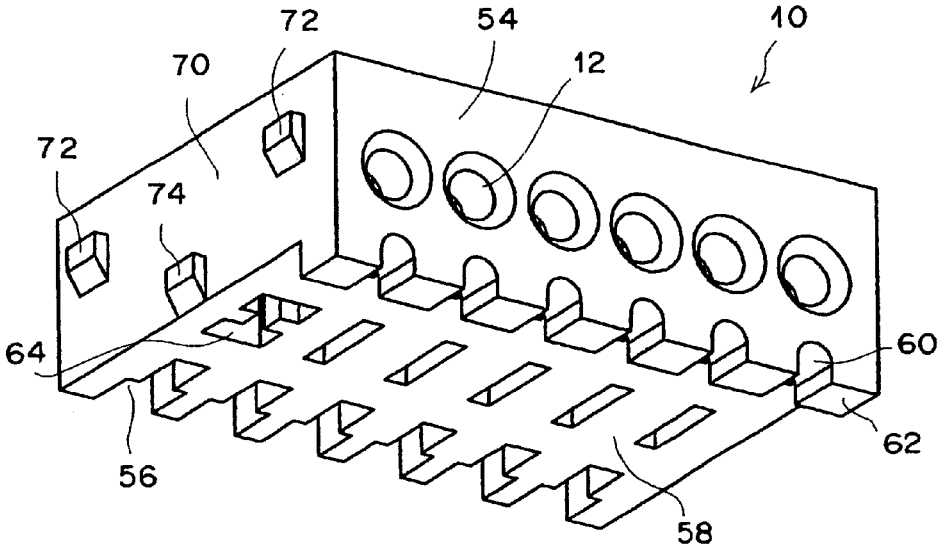
FIG. 11 is a perspective view of the cover housing shown in FIG. 10, as seen from below and to the rear.
Figure 12:
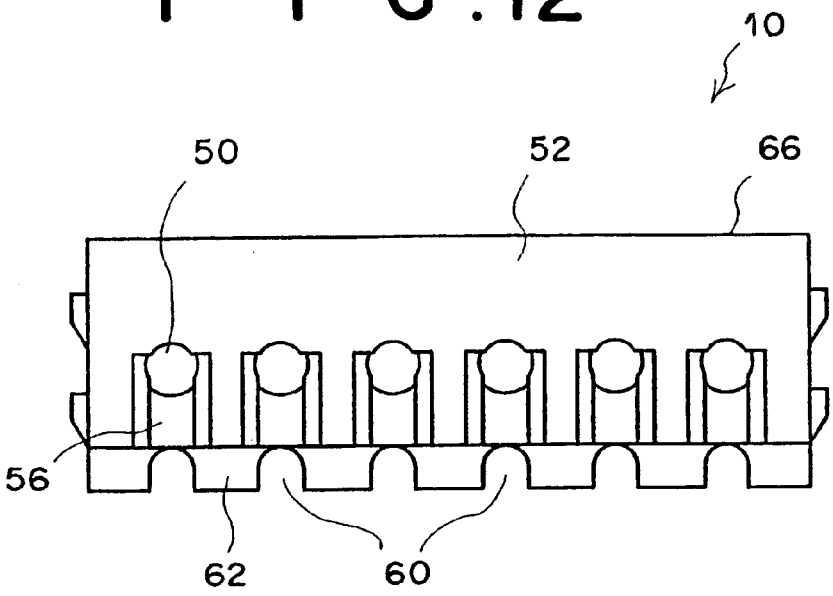
FIG. 12 is a front view of the cover housing shown in FIG. 10.
Figure 13:
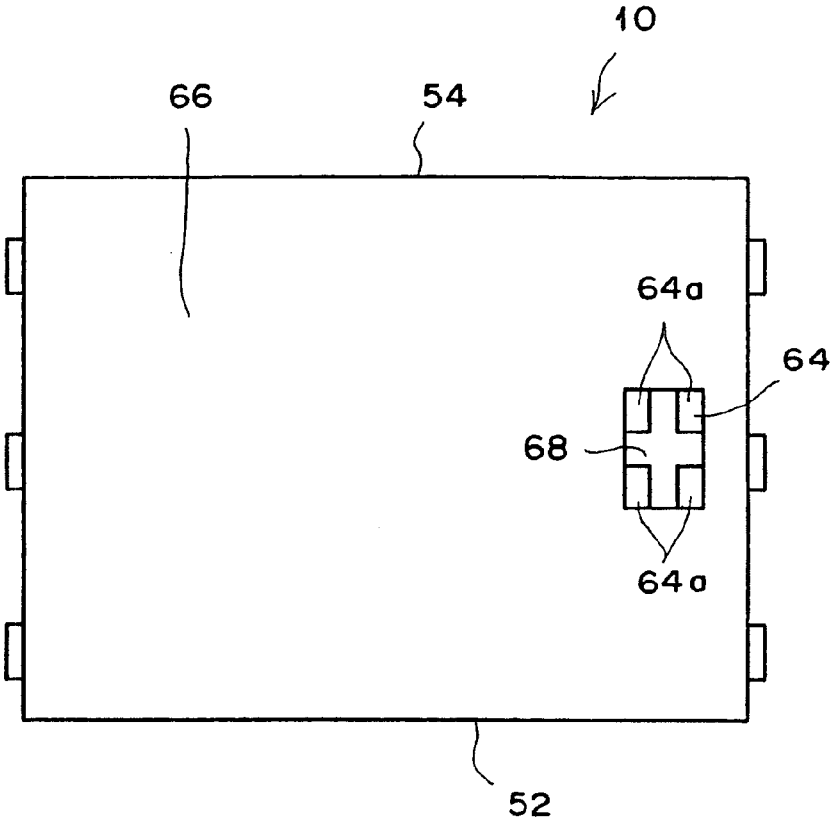
FIG. 13 is a plan view of the cover housing shown in FIG. 10.
Figure 14:
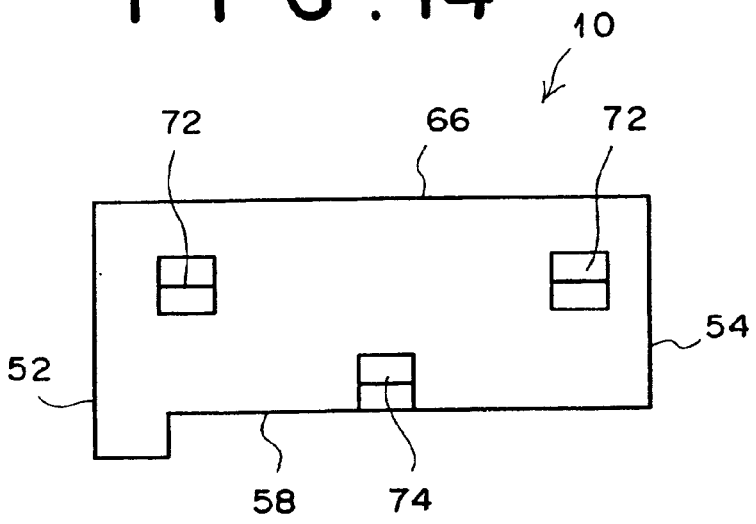
FIG. 14 is a side view of the cover housing shown in FIG. 10.
Figure 15:
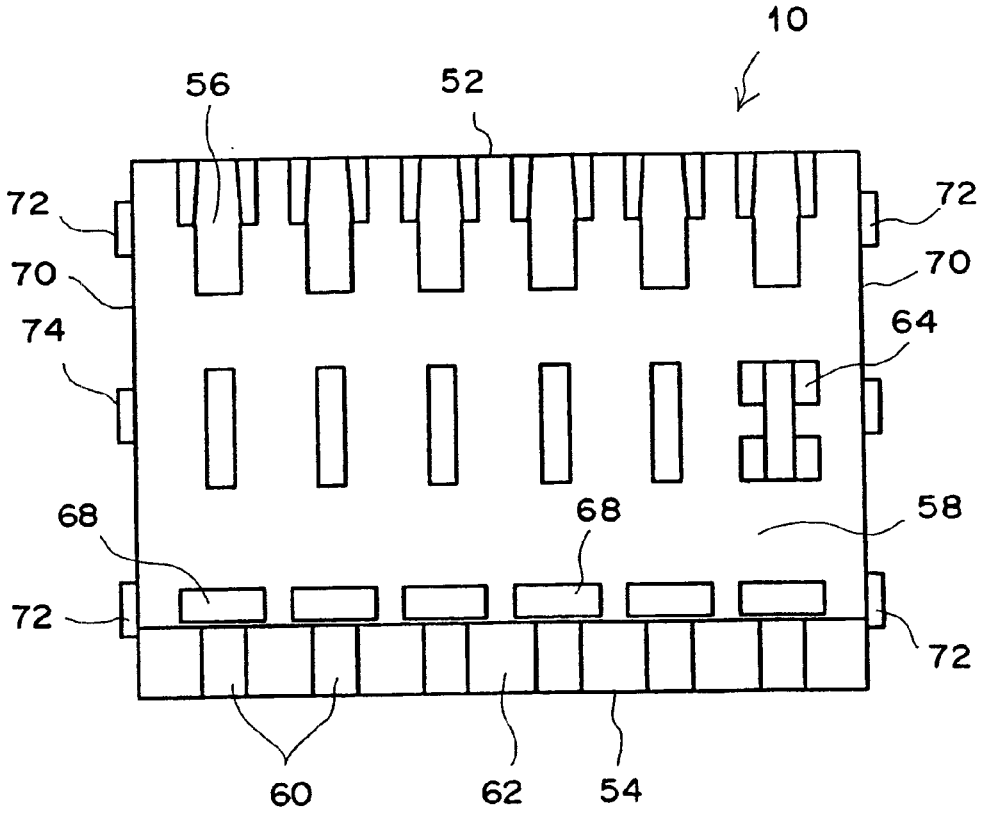
FIG. 15 is a bottom view of the cover housing shown in FIG. 10.
Figure 16:
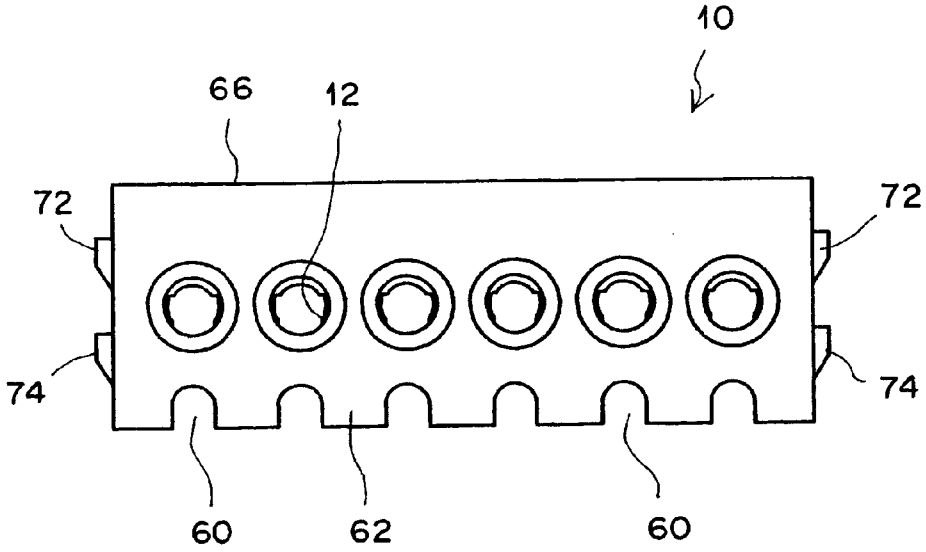
FIG. 16 is a rear view of the cover housing shown in FIG. 10.

Next, the cover housing (cover member) 10 will be described with reference to FIGS. 10 through 16. FIG. 10 is a perspective view of the cover housing 10 as seen from below and in front. FIG. 11 is a perspective view of the cover housing 10 as seen from below and to the rear. FIG. 12 is a front view, FIG. 13 is a plan view, FIG. 14 is a left-side view, FIG. 15 is a bottom view, and FIG. 16 is a rear view of the cover housing. The cover housing 10 is formed from an insulating synthetic resin, and has a substantially rectangular block shape. Electrical wire accommodating passages (hereafter referred to simply as "passages") 50 (FIG. 12) through which electrical wires 190 (FIGS. 23 and 24) are passed and held are formed in the cover housing 10. The passages 50 pass through the cover housing 10 from the front surface 52 to the rear surface 54. Grooves 56 which accommodate the tip end portions of contacts 100 (described later) are formed in the front surface 52 of the cover housing 10. The grooves 56 open in the front surface 52 and lower surface 58 of the cover housing 10. The above-mentioned passages 50 communicate with the grooves 56. A protruding wall 62 which has U-shaped cut-outs 60 is formed on the rear end of the lower surface 58. A probe (not shown in the figures) used for an electrical continuity check is inserted into these cut-outs 60. Furthermore, H-shaped opening parts 64 are formed between the protruding wall 62 and the grooves 56 in positions aligned with the respective passages 50. Note that only a single H-shaped opening part 64 is shown in the figures; the remaining H-shaped opening parts are omitted. Protruding tongue parts (connection parts) 106 (FIG. 17) that act as the piercing parts of the contacts 100 are accommodated in the opening parts 64. Furthermore, these opening parts 64 pass through the cover housing 10 to the upper surface 66 of the cover housing 10 (FIG. 13). Clips (elastic supporting members) 160 (FIG. 19) that will be described later are inserted into these opening parts 64 from the side of the upper surface 66. Furthermore, cruciform parts 68 which are slightly recessed from the upper surface 66 are formed as integral parts in the opening parts 64 on the side of the upper surface 66 (FIG. 13). Accordingly, four apertures 64*a* (excluding these cruciform parts 68) communicate with the bottom.

As is shown most clearly in FIGS. 10 and 15, elongate openings 68 which extend along the protruding wall 62 are formed immediately to the inside of the protruding wall 62 in positions corresponding to the cut-outs 60. Electrical wire anchoring parts 120 of the contacts 100 (which will be described later) are accommodated in these openings 68. On the side surfaces 70 of the cover housing 10, two anchoring projections 72 which are separated from each other along the upper surface 66 on the side of the upper surface 66, and one anchoring projection 74 which is formed on the side of the lower surface 58, are caused to protrude from the cover housing 10 as integral parts of the cover housing 10. When the cover housing 10 is pushed slightly into the housing 2 and attached, the anchoring projections 74 are temporarily fastened by being anchored in the upper ends of the above-mentioned central recessed grooves 38. Specifically, this position is the temporary anchoring position of the cover housing 10. In this case, since the anchoring projections 72 are positioned above the upper edges 36 of the housing 2, there is no unintentional entry of the cover housing 10 into the recess 8 as a result of the application of an external force. Next, when the cover housing 10 is pushed further inward in order to connect the electrical wires, the anchoring projections 72 engage with the upper ends of the recessed grooves 38 on both sides and are locked. This position is the main anchoring position of the cover housing 10.

Figure 17:
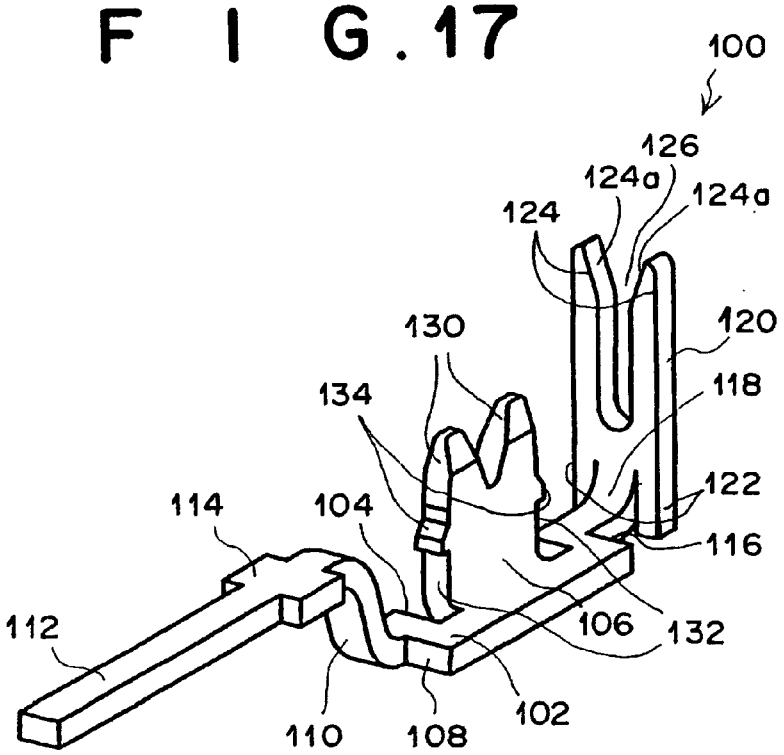
FIG. 17 is a perspective view of [one of] the contacts used in the connector shown in FIG. 1.
Figure 18A:
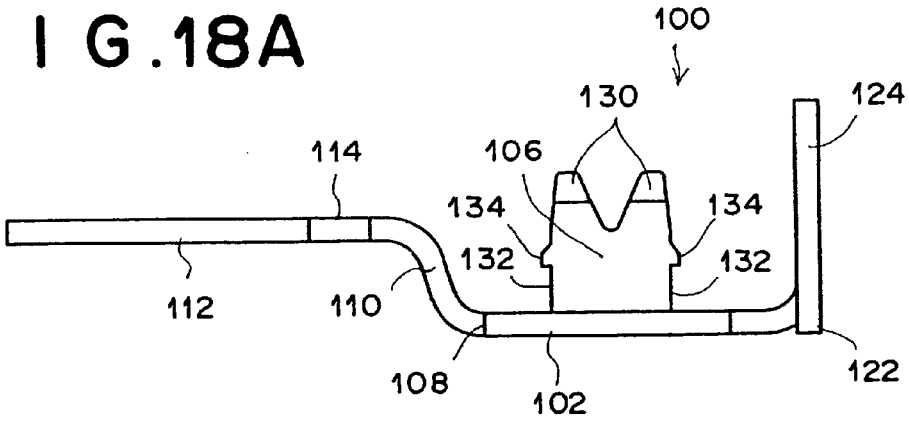
FIG. 18A is a right-side view.
Figure 18B:
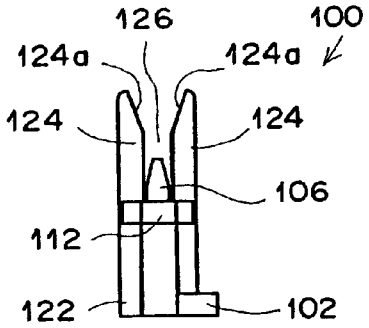
FIG. 18B is a front view.
Figure 18C:
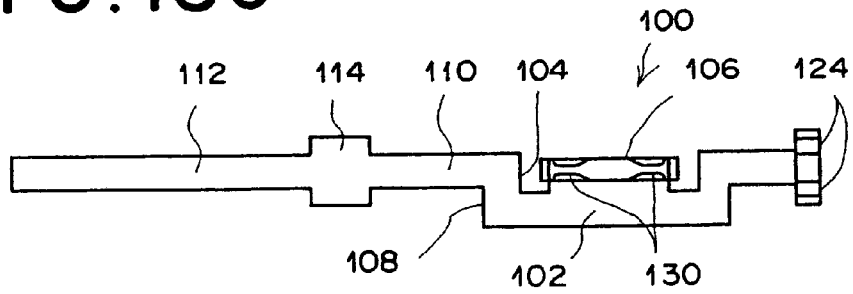
FIG. 18C is a plan view.
Figure 18D:
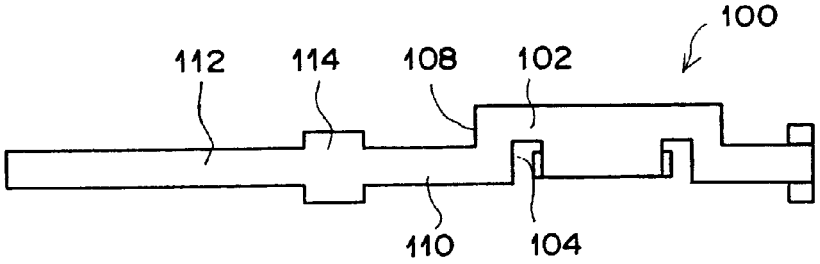
FIG. 18D is a bottom view.

Next, the contacts 100 that are attached to the housing 2 will be described with reference to FIGS. 17 and 18. FIG. 17 is a perspective view of one of the contacts 100, FIG. 18A is a right-side view of this contact 100, FIG. 18B is a front view, FIG. 18C is a plan view, and FIG. 18D is a bottom view of the contact 100. Each contact 100 has a base part 102, and a protruding tongue part, i.e., a connection part 106, which is bent and caused to protrude upward from the base part 102 inside a cut-out 104 formed in one side of this base part 102. The protruding tongue part (piercing part) 106 has a sharp projection 130 whose tip end is separated into two parts. Details will be described later; however, the insulating outer covering of the corresponding electrical wire is pierced by this projection 130, so that the projection 130 and the core wire (conductor) (not shown in the figures) of the electrical wire make contact with each other. Barbs (engaging parts) 134 which engage with the opening parts 64 in the cover housing 10 are formed on both side edges 132 of each protruding tongue part 106. As a result of the engagement of these barbs 134 with the cover housing 10, the protruding tongue parts 106 are directly fastened to the cover housing 10. As a result, the connected electrical wires 190 can be securely held between the protruding tongue parts 106 and the cover housing 10.

A transition part 110 which is bent upward and forward from the front end 108 of the base part 102, and a contact part 112 which extends forward from the transition part 110 in an attitude substantially parallel to the base part 102, are formed on each contact 100. A rectangular tab 114 is formed on the base end of the contact part 112; this tab 114 acts as an anchoring part when the contact 100 is mounted in the housing 2. A connecting part 118 is formed which extends rearward while bending upward from the rear end 116 of the base part 102, and an electrical wire anchoring part 120 is formed on the tip end of the connecting part 118 as an integral part of this connecting part 118. The electrical wire anchoring part 120 is formed in an upright position perpendicular to the base part 102, and has leg parts 122 positioned on both sides of the connecting part 118, and two anchoring pieces 124 which extend upward and are separated from each other. Tapers 124*a* are formed on the insides of the tip end of the anchoring pieces 124, so that the accommodation of the electrical wire 190 is facilitated. The anchoring pieces 124 are separated from each other so that a slot 126 is formed between these anchoring pieces 124. The corresponding electrical wire 190 is accommodated in this slot 126. At the time of this accommodation, the electrical wire 190 is supported so that this slot 126 bites into the insulating outer covering of the electrical wire 190; accordingly, movement of the electrical wire 190 in the elongate direction of the electrical wire is prevented. When each contact 100 is attached to the housing 2, the base part 102 of the contact 100 is carried on the bottom surface 42 of the recess 8 of the housing 2. Furthermore, the contact part 112 is disposed in the corresponding square hole 30 of the housing 2.

Figure 19:
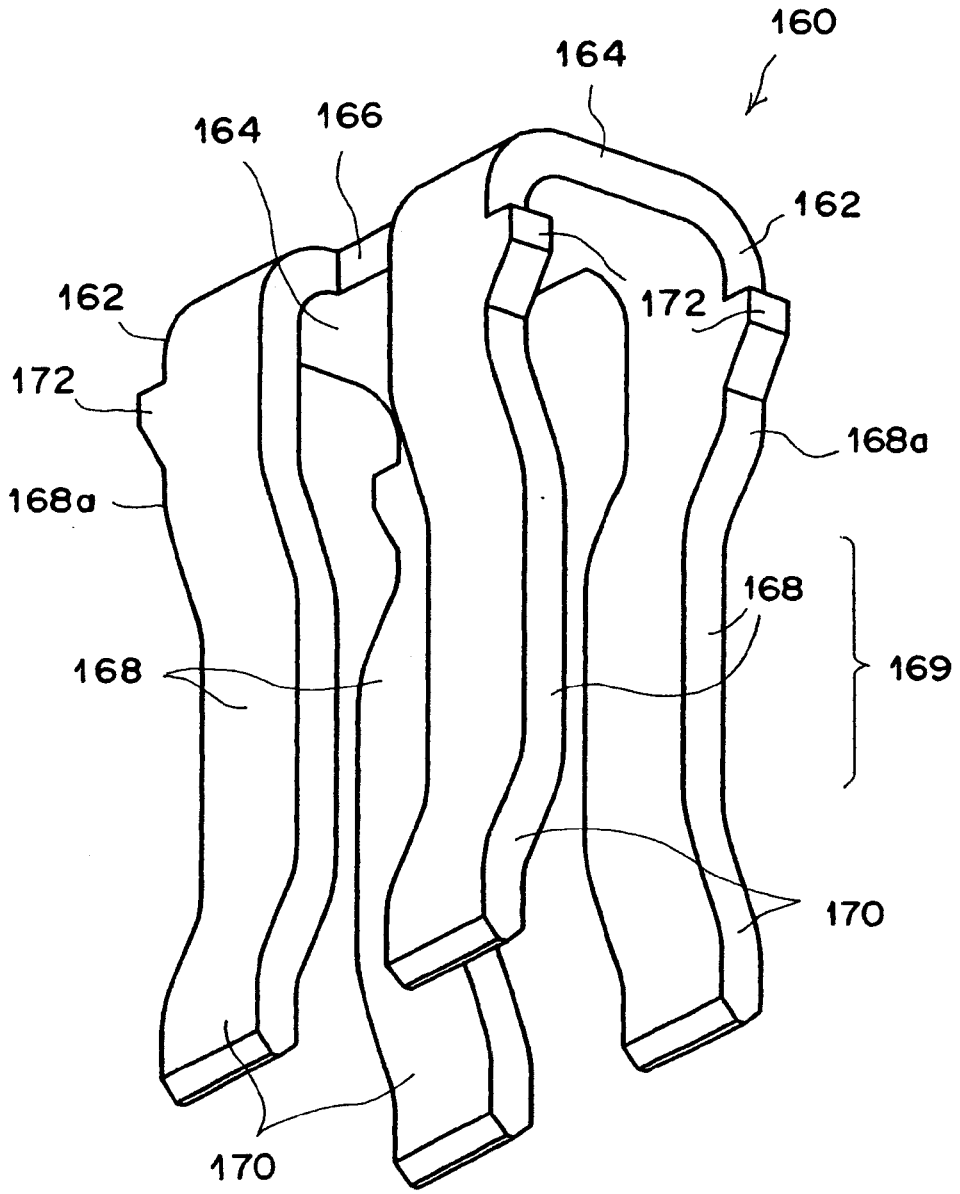
FIG. 19 is a perspective view of [one of] the clips used in the connector shown in FIG. 1.
Figure 20A:
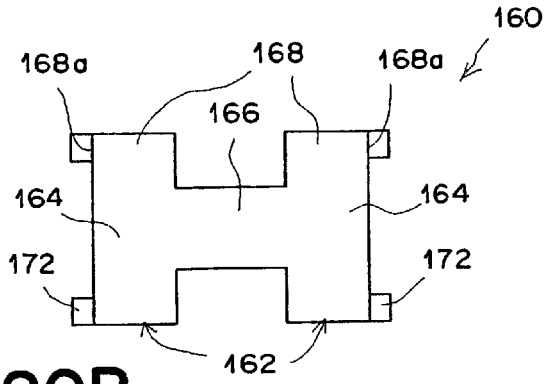
FIG. 20A is a plan view.
Figure 20B:
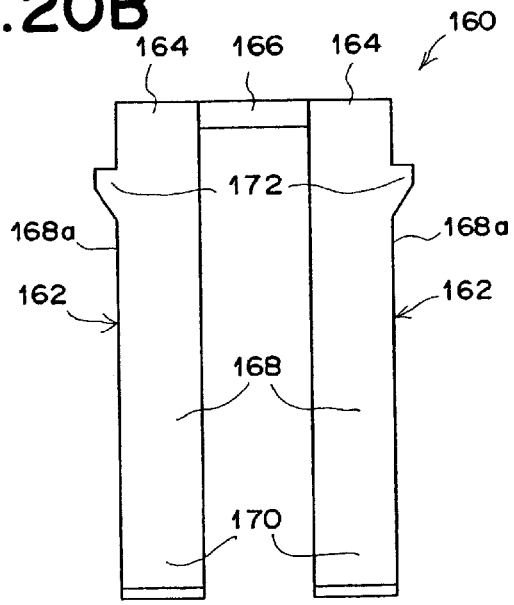
FIG. 20B is a side view.
Figure 20D:
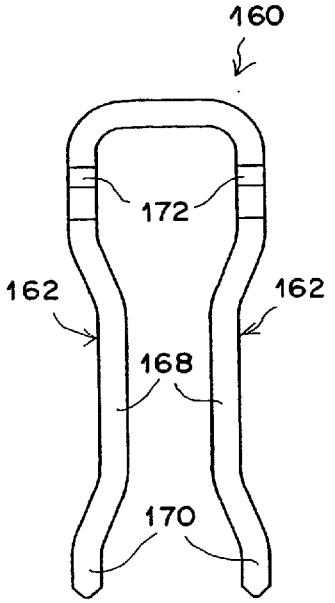
FIG. 20D is a front view.
Figure 20C:
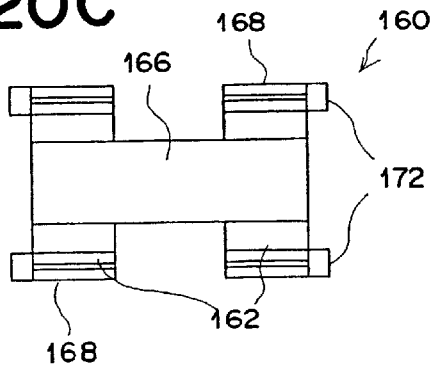
FIG. 20C is a bottom view.

Next, the clips 160, i.e., the elastic supporting members, will be described with reference to FIGS. 19 and 20. FIG. 19 is a perspective view of one of the clips 160. FIG. 20A is a plan view, FIG. 20B is a side view, FIG. 20C is a bottom view, and FIG. 20D is a front view. Each clip 160 is formed by stamping and forming a plate-form metal elastic member such as stainless steel. Each clip 160 has a shape in which two substantially U-shaped parts 162 are connected into an integral unit by a connecting part 166 at the base end 164. Each part 162 has two supporting arms 168 that extend in the same direction from both sides of the base end 164.

The supporting arms 168 are constructed so that the gap between the supporting arms 168 is narrowed in the central portions 169 of the supporting arms 168, and then again widens at the tip end portions 170. Furthermore, a barb 172 which protrudes outward in the same plane as the supporting arm 168 is formed on the outward-facing side edge 168*a* in the vicinity of the base end 164 of each supporting arm 168. At the time of attachment to the cover housing 10, these barbs 172 interfere and engage with the inside walls of the opening parts 64 of the cover housing 10, so that the clips 160 are fastened to the cover housing 10. The clips 160 are slightly inserted into the opening parts 64 of the cover housing 10 and temporarily fastened; next, after the electrical wires have been inserted into the cover housing 10, the clips 160 are pushed into the cover housing 10 and fastened so that the electrical wires 190 are supported. Furthermore, the clips may also be constructed from an insulating elastic material such as a synthetic resin, and may also be formed as integral parts of the cover housing 10.

Figure 21:
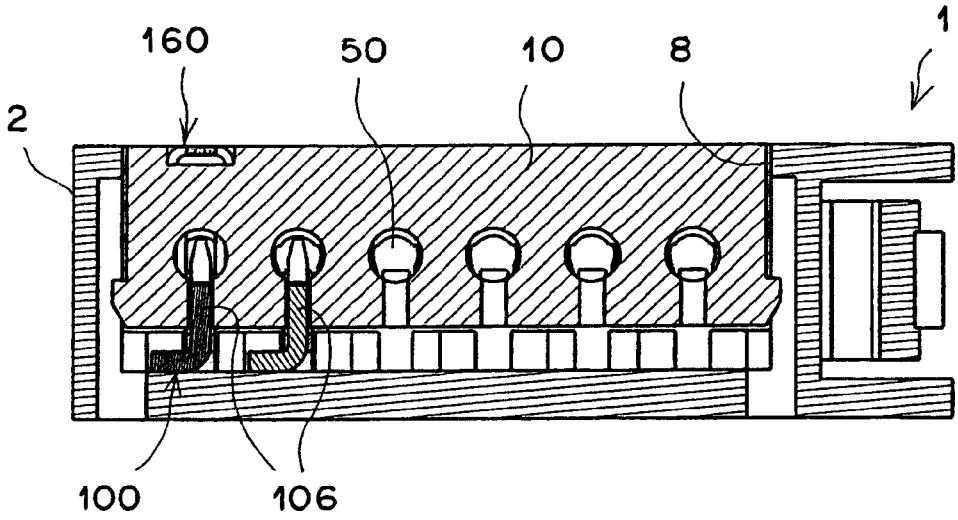
FIG. 21 is a sectional view of the connector of the first embodiment along line 21—21 in FIG. 2.
Figure 22:
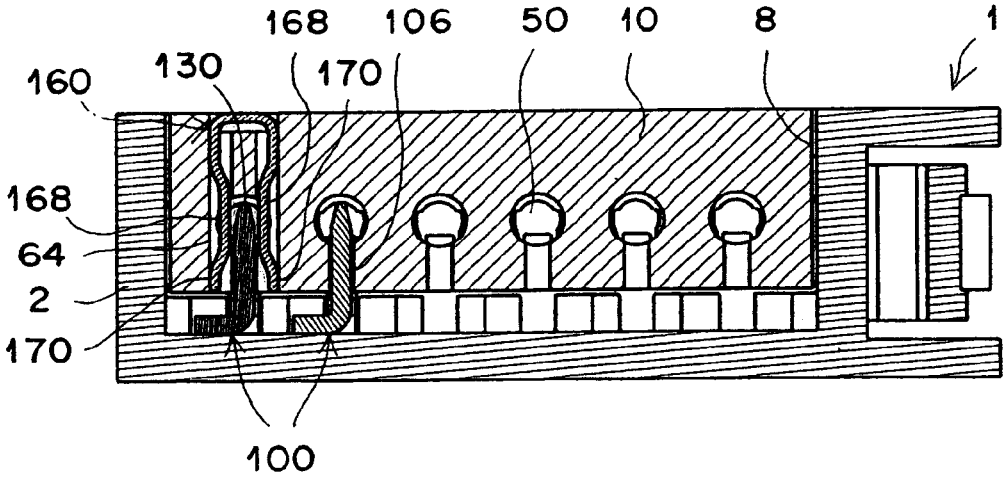
FIG. 22 is a sectional view of the connector of the first embodiment along line 22—22 in FIG. 2.
Figure 23:
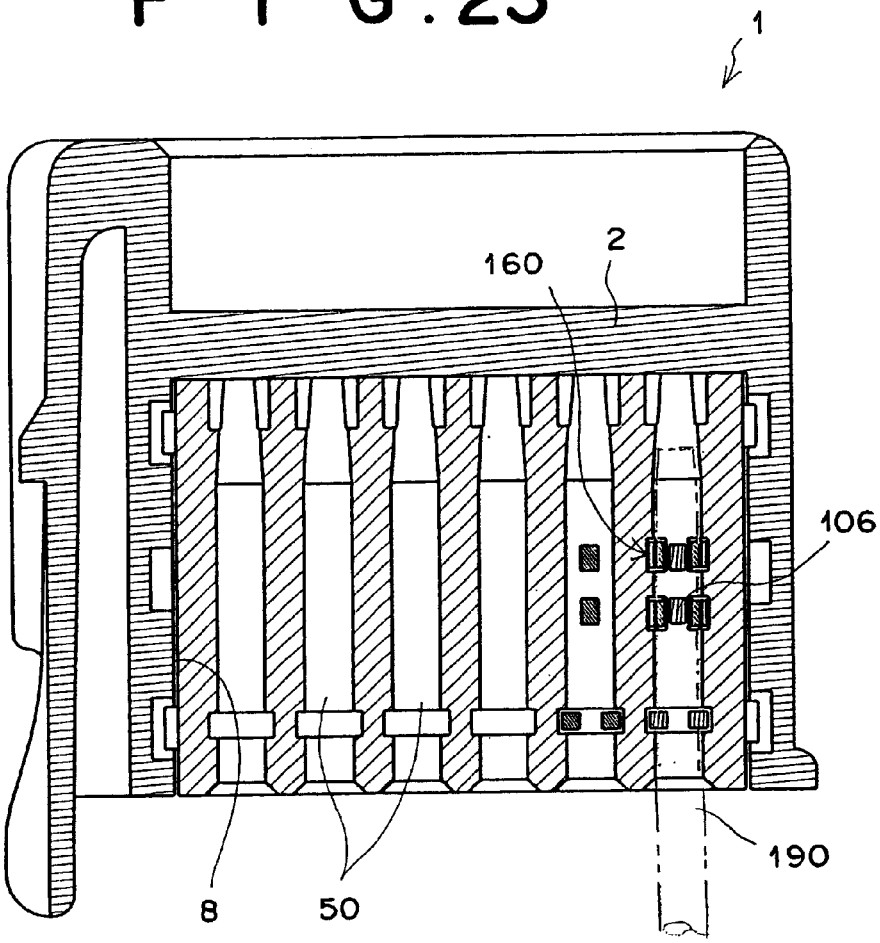
FIG. 23 is a sectional view of the connector of the first embodiment along line 23—23 in FIG. 2.
Figure 24:
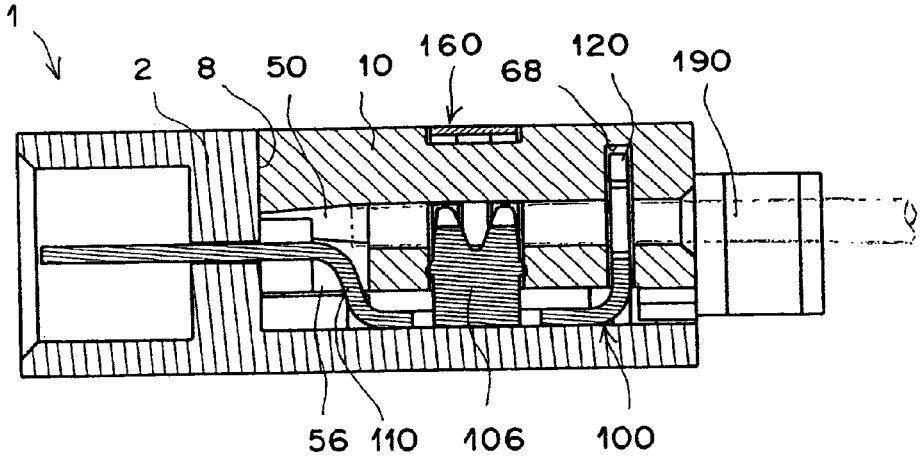
FIG. 24 is a sectional view of [the connector of] the first embodiment along line 24—24 in FIG. 2.

Next, the state in which the electrical wires 190 are connected to the connector 1 will be described with reference to FIGS. 21 through 24. FIG. 21 is a sectional view of the connector 1 along line 21—21 in FIG. 2, FIG. 22 is a sectional view of the connector 1 along line 22—22 in FIG. 2, FIG. 23 is a sectional view of the connector 1 along line 23—23 in FIG. 2, and FIG. 24 is a sectional view of the connector 1 along line 24—24 in FIG. 2. Furthermore, FIGS. 21 through 24 all show a state in which the cover housing 10 has been pushed completely into the housing 2, so that the electrical wires 190 are connected to the contacts 100.

Prior to the establishment of this connected state, the cover housing 10 to which the clips 160 have been temporarily anchored is temporarily anchored in the recess 8 of the housing 2. Next, the electrical wires 190 are inserted into the passages 50 from the round apertures 12 of the cover housing 10. In this stage, the end portions, i.e., tip ends, of the inserted electrical wires 190 are not held by the clips 160. When the cover housing 10 is pushed further into the recess 8 from this state of temporary anchoring using a common tool such as pliers, the protruding tongue parts 106 of the contacts 100 pierce the outer coverings of the electrical wires 190, and bite into the conductors of the electrical wires 190. The positions of the protruding tongue parts 106 in this case are shown in the respective figurers. However, the electrical wires inside the passages 50 are omitted from FIGS. 21 and 22.

In the connected state, the supporting arms 168 of the clips 160 are positioned to correspond to the projections 130 of the protruding tongue parts 106 (FIG. 23). As a result, the insulating outer coverings of the electrical wires 190 electrically connected by the projections 130 are elastically pressed toward the projections 130 of the protruding tongue parts 106 from both sides by the supporting arms 168 of the clips 160 (FIG. 22). In this case, the spread tip end portions 170 of the clips 160 contact the inside walls of the opening parts 64 inside the opening parts 64. Consequently, the supporting arms 168 can effectively press the insulating outer coverings toward the projections 130. Accordingly, the core wires of the electrical wires 190 and the contacts are constantly maintained in contact at the protruding tongue parts 106, so that the reliability of the electrical connections is high. Furthermore, it is clearly shown in FIG. 24 that the electrical wire anchoring parts 120 of the contacts 100 are disposed inside the openings 68 of the cover housing 10. Moreover, it is seen that the transition parts 110 of the contacts 100 are disposed in the grooves 56 of the cover housing 10.

Figure 25A:
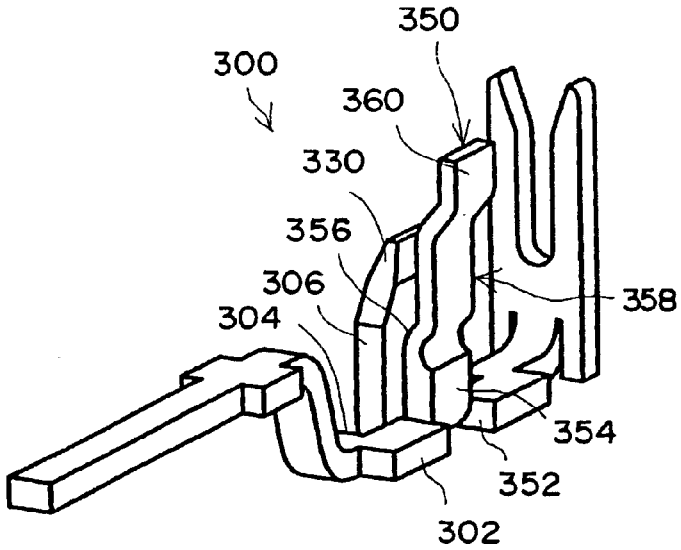
Figure 25B:
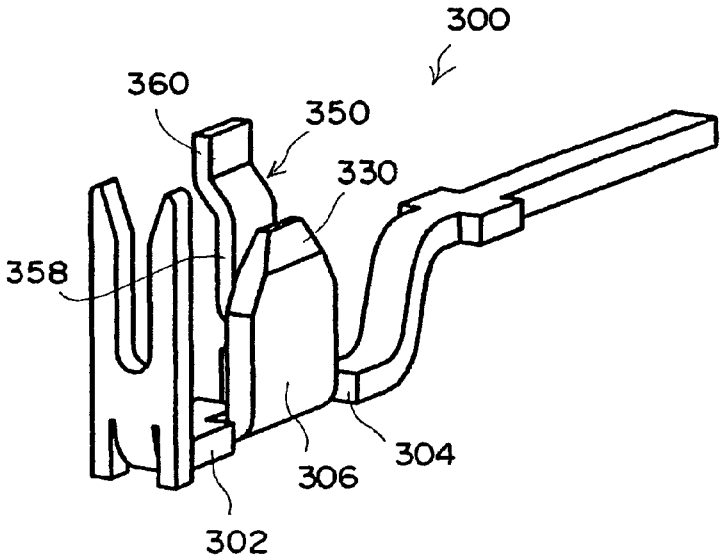
FIG. 25B is a perspective view of the contact as viewed from the rear.
Figure 26A:
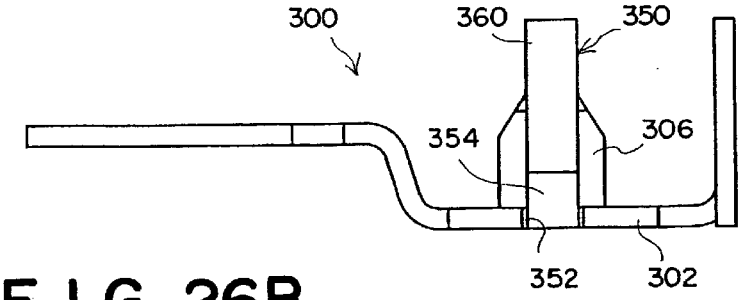
FIG. 26 shows the contact shown in FIG. 25.
FIG. 26B is a front view.
FIG. 26C is a rear view.
FIG. 26D is a plan view.
FIG. 26E is a bottom view.
FIG. 26F is a left-side view.
Figure 26B:
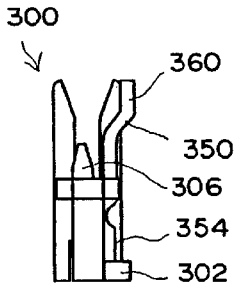
Figure 26C:
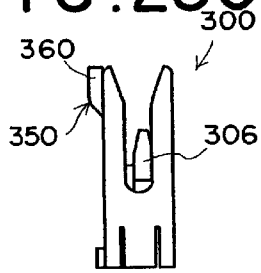
Figure 26D:
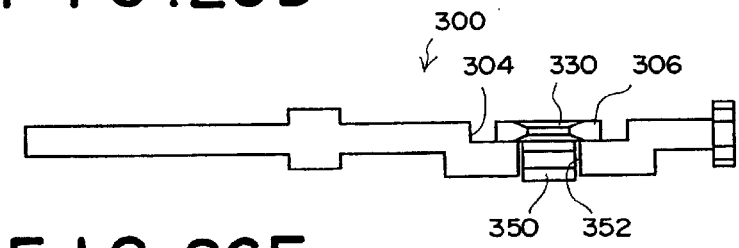
Figure 26E:
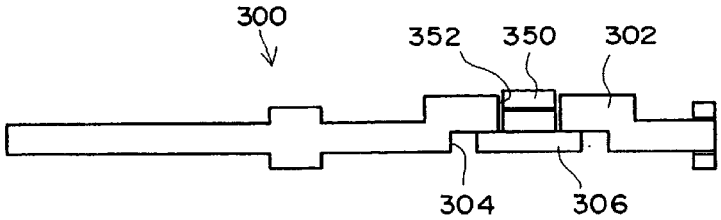
Figure 26F:
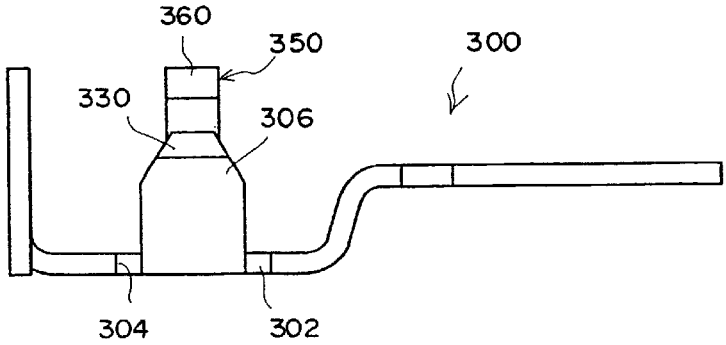

Next, a second embodiment of the present invention will be described with reference to FIGS. 25 and 26. FIG. 25 shows one of the contacts used in the connector of the second embodiment. FIG. 25A is a perspective view (similar to FIG. 7) of this contact 300 as seen from the front, and FIG. 25B is a perspective view of the contact 300 as seen from the rear. FIG. 26 shows various views of the contact 300; FIG. 26A is a right-side view of the contact 300, FIG. 26B is a front view, FIG. 26C is a rear view, FIG. 26D is a plan view, FIG. 26E is a bottom view, and FIG. 26F is a left-side view. Furthermore, in the following description, parts that are the same as in the first embodiment will be described using the same reference numbers.

This embodiment differs from the first embodiment in that electrical wire retaining parts (elastic supporting members) 350 that are integral parts of the contacts 300 are formed adjacent to the protruding tongue parts 306 instead of the aforementioned clips 160. As a result, the number of parts required can be reduced. The protruding tongue parts 306 are formed inside cut-outs 304 in the base parts 302; however, the shape of these protruding tongue parts 306 is different from that of the protruding tongue parts 106 in the first embodiment. The tip ends of the protruding tongue parts 306 are formed as pointed projections 330. Meanwhile, the electrical wire retaining parts (hereafter referred to simply as "retaining parts") 350 are caused to protrude adjacent to the contacts 300 in the direction perpendicular to the axial direction of the contacts 300, so that these retaining parts 350 face in the same direction as the protruding tongue parts 306.

In each base part 302, a cut-out 352 is formed on the opposite side from the cut-out 304, and the retaining part 350 is formed so that this retaining part 350 is cut and raised from the cut-out 352. The retaining part 350 has a base end part 354 that extends upward from the cut-out 352, an intermediate part 358 which extends further upward from the base end part 354 via a step 356 which is formed so that the intermediate part 358 is separated from the protruding tongue part 306, and a tip end part 360 which extends upward from this intermediate part 358 while being displaced outward so that this tip end part 360 is separated even further from the protruding tongue part 306. The electrical wire 190 connected to the projection 330 is pressed toward the protruding tongue part 306 from one side by the intermediate part 358. The remaining portions of the contacts 300 are the same as the corresponding portions of the contacts 100; accordingly, a detailed description is omitted.

Figure 27A:
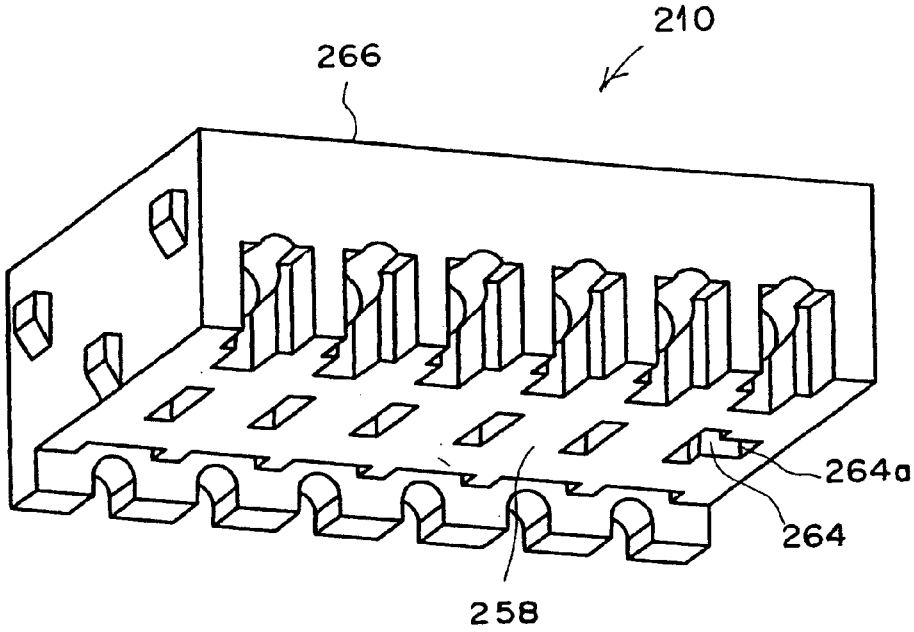
Figure 27B:
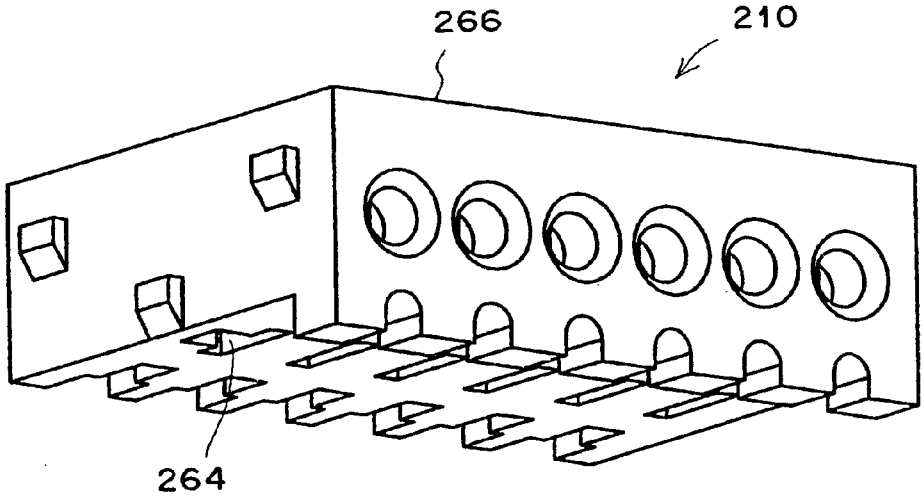
FIG. 27B is a perspective view as seen from the rear.

Next, the cover housing 210 in which these contacts 300 are disposed will be described with reference to FIG. 27. FIG. 27 shows perspective views of the cover housing 210; FIG. 27A is a perspective view of the cover housing 210 as seen from the front, while FIG. 27B is a perspective view of the cover housing 210 as seen from the rear. The cover housing 210 differs from the cover housing 10 in that the shape of the opening parts 264 is different. While the opening parts 64 of the cover housing 10 are H-shaped, the opening parts 264 of the cover housing 210 have an inverted T shape. This shape results from the fact that the portion that accommodates the aforementioned retaining part 350 is formed as a single slot 264*a*. Furthermore, as is clear from FIG. 28, the opening parts 264 do not pass through the upper surface 266. As in the first embodiment, only a single opening part 264 is shown; the remaining opening parts 264 are omitted. The remaining parts of the cover housing 210 basically have the same shape as the corresponding parts of the cover housing 10; accordingly, a detailed description is omitted.

Figure 28:
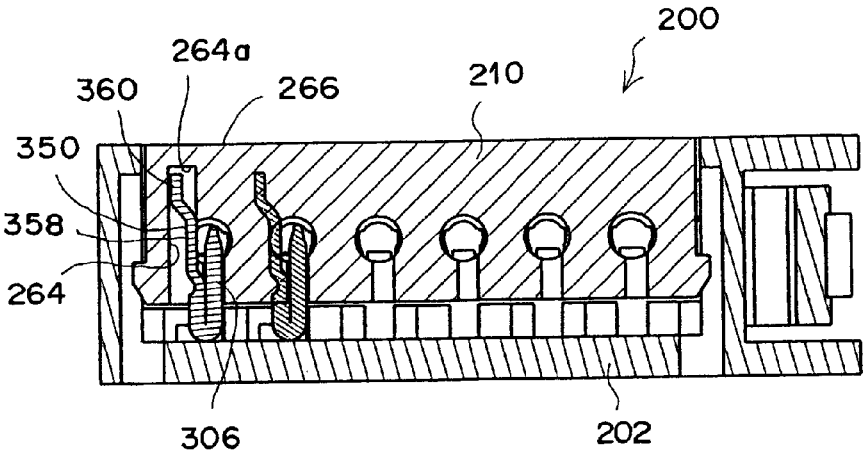
FIG. 28 is a sectional view (similar to FIG. 22) of the connector of the second embodiment of the present invention.
Figure 29:
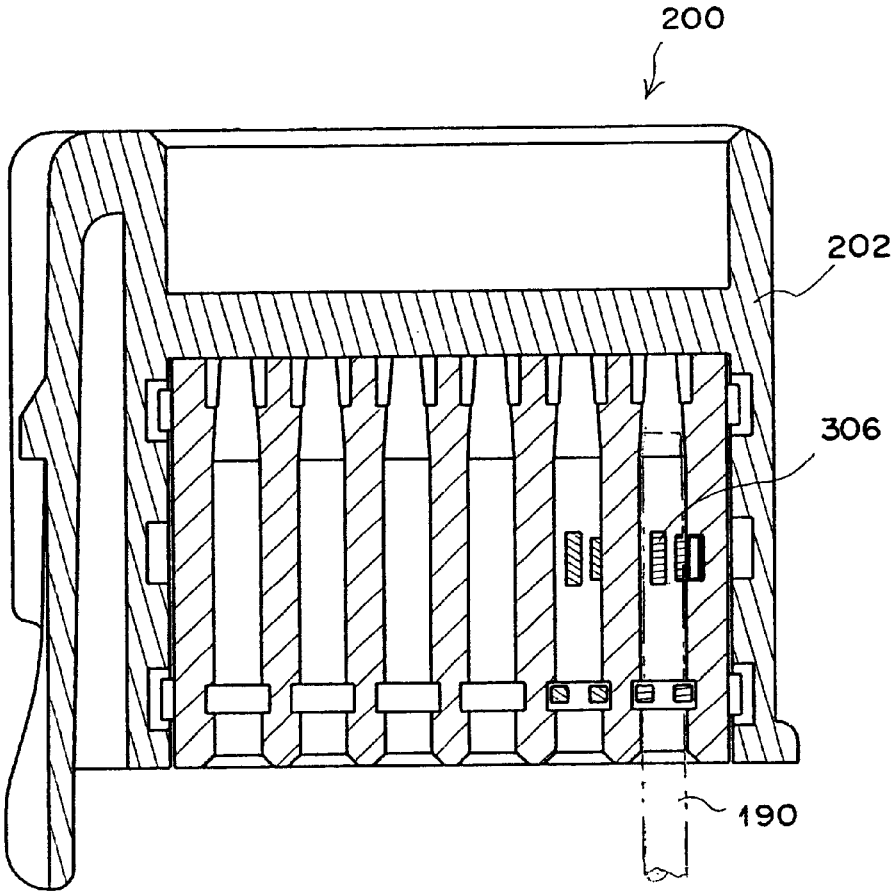
FIG. 29 is a sectional view (similar to FIG. 23) of the connector of the second embodiment of the present invention.
Figure 30:
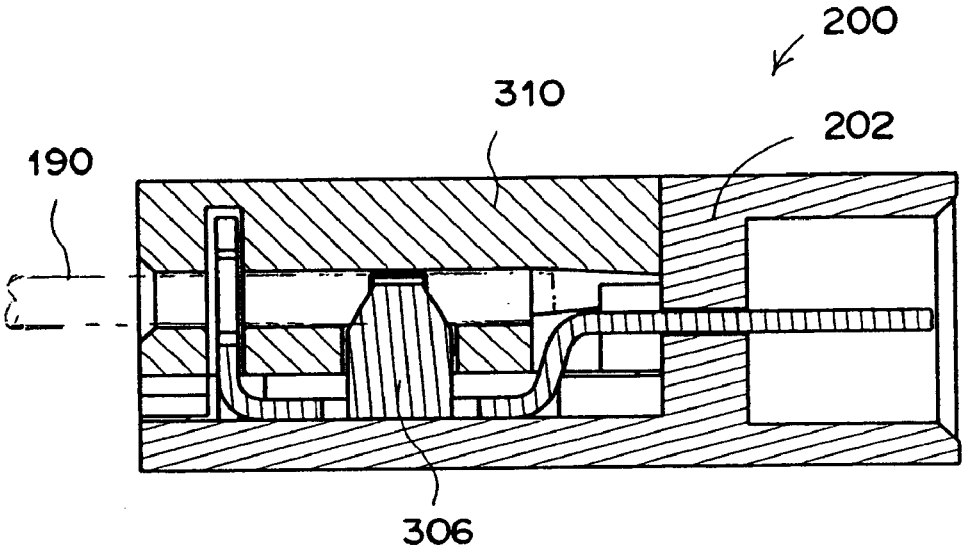
FIG. 30 is a sectional view (similar to FIG. 24) of the connector of the second embodiment of the present invention.

Next, the state in which the connector 200 of the second embodiment is connected with the electrical wires 190 will be described with reference to FIGS. 28, 29 and 30. FIG. 28 is a sectional view of the connector 200 similar to FIG. 22, FIG. 29 is a sectional view of the connector 200 similar to FIG. 23, and FIG. 30 is a sectional view of the connector 200 similar to FIG. 24. However, FIG. 30 differs from FIG. 24 in that the view is from the opposite side. As is shown in FIG. 28, the tip end parts 360 of the retaining parts 350 are disposed inside the slots 264*a*, and the intermediate parts 358 press the insulating outer coverings of the electrical wires 190 connected to the protruding tongue parts 306 toward the protruding tongue parts 306 from the outside. In this case, the tip end parts 360 of the retaining parts 350 contact the inside walls of the slots 264*a;* accordingly, the intermediate parts 358 of the retaining parts 350 can effectively press the insulating outer coverings toward the protruding tongue parts 306. As a result, a state of good electrical connection is constantly maintained.

What is claimed is:

1. An electrical connector comprising:

an insulating housing which has a recess that opens to the outside;

contacts which are disposed inside said recess and which have connection parts;

an insulating cover member which is mounted in said recess and which connects electrical wires to said connection parts by pressing said electrical wires against said connection parts;

said connection parts having a protruding shape, and said connection parts being constructed so that said connection parts pierce said insulating outer covering of said electrical wires and are connected to conductors of said electrical wires; and elastic supporting members that support said outer covering portions of said electrical wires connected to said connection parts so that said outer covering portions are pressed toward said connection parts and are disposed adjacent to said connection parts at sides of said connection parts, said elastic supporting members are formed as integral parts of said contacts, and said elastic supporting members have a free end that engages said cover member to press said outer covering portions toward said connection parts.

2. The electrical connector claimed in claim 1 wherein said elastic supporting members are metal members.

3. The electrical connector claimed in claim 1 wherein said elastic supporting members are insulating members.

4. The electrical connector claimed in claim 1 wherein said elastic supporting members are metal members.

5. The electrical connector claimed in claim 1 wherein said elastic supporting members are insulating members.

6. An electrical connector comprising:

an insulating housing which has a recess that opens to the outside;

contacts which are disposed inside said recess and which have connection parts;

an insulating cover member which is mounted in said recess and which connects electrical wires to said connection parts by pressing said electrical wires against said connection parts;

said connection parts having a protruding shape, and said connection parts being constructed so that said connection parts pierce said insulating outer covering of said electrical wires and are connected to conductors of said electrical wires;

elastic supporting members that support the outer covering portions of said electrical wires connected to said connection parts so that said outer covering portions are pressed toward said connection parts and are disposed adjacent to said connection parts at sides of said connection parts, said elastic supporting members are formed as integral parts of said contacts, and said elastic supporting members have a free end that engages said cover member to press said outer covering portions toward said connection parts; and said connection parts have engaging parts that engage with said cover member mounted in said recess.

7. The electrical connector claimed in claim 6 wherein said engaging parts are barbs formed on both sides of said connection parts.

* * * * *

UNITED STATES PATENT AND TRADEMARK OFFICE

CERTIFICATE OF CORRECTION

PATENT NO. : 6,579,115 B2
DATED : June 17, 2003
INVENTOR(S) : Daisuke Mitsugi

It is certified that error appears in the above-identified patent and that said Letters Patent is hereby corrected as shown below:

Column 11,
Renumber the following claims:
Claim 6 should be changed to Claim 4, Claim 4, should be changed to Claim 5, Claim 5 should be changed to Claim 6

Signed and Sealed this

Twenty-fourth Day of February, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,579,115 B2
DATED : June 17, 2003
INVENTOR(S) : Daisuke Mitsugi

It is certified that error appears in the above-identified patent and that said Letters Patent is hereby corrected as shown below:

Column 11,
Line 1, the claim dependency "1" should read -- 4 --.
Line 3, the claim dependency "1" should read -- 4 --.

Signed and Sealed this

Sixth Day of July, 2004

JON W. DUDAS
*Acting Director of the United States Patent and Trademark Office*